US009244433B2

(12) United States Patent
Behra et al.

(10) Patent No.: US 9,244,433 B2
(45) Date of Patent: Jan. 26, 2016

(54) MELODY SELECTION MECHANISM FOR A STRIKING TIMEPIECE

(71) Applicant: Blancpain SA, Le Brassus (CH)

(72) Inventors: Julien Behra, Morez (FR); Edmond Capt, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 14/707,721

(22) Filed: May 8, 2015

(65) Prior Publication Data

US 2015/0338828 A1 Nov. 26, 2015

(30) Foreign Application Priority Data

May 21, 2014 (EP) ..... 14169217

(51) Int. Cl.

| | |
|---|---|
| ***G04B 21/02*** | (2006.01) |
| ***G04B 21/00*** | (2006.01) |
| ***G04B 21/12*** | (2006.01) |
| ***G04B 21/04*** | (2006.01) |

(52) U.S. Cl.

CPC ..... *G04B 21/02* (2013.01); *G04B 21/00* (2013.01); *G04B 21/04* (2013.01); *G04B 21/12* (2013.01)

(58) Field of Classification Search

CPC ..... G04B 21/00; G04B 21/02; G04B 21/04; G04B 21/06; G04B 21/08; G04B 21/10; G04B 21/12; G04B 23/06; G04B 23/10; G04B 23/026

See application file for complete search history.

(56) References Cited

U.S. PATENT DOCUMENTS

| | | | | |
|---|---|---|---|---|
| 7,021,819 | B2 * | 4/2006 | Schmiedchen | G04B 23/02 368/147 |
| 2007/0242568 | A1 * | 10/2007 | Goeller | G04B 21/12 368/66 |
| 2008/0008052 | A1 * | 1/2008 | Moteki | G04B 21/12 368/260 |
| 2008/0144448 | A1 * | 6/2008 | Goeller | G04B 21/12 368/190 |
| 2008/0192585 | A1 * | 8/2008 | Corthesy | G04B 21/12 368/268 |
| 2012/0230156 | A1 * | 9/2012 | Goeller | G04B 21/00 368/72 |
| 2012/0230163 | A1 | 9/2012 | Goeller et al. | |
| 2013/0121120 | A1 * | 5/2013 | Greubel | G04B 11/006 368/267 |

FOREIGN PATENT DOCUMENTS

| | | |
|---|---|---|
| EP | 1 770 453 A1 | 4/2007 |
| EP | 2 498 145 A1 | 9/2012 |

OTHER PUBLICATIONS

European Search Report issued Feb. 20, 2015 in European Application 14169217.8, filed May 21, 2014 (with English translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Timepiece or watch (1000) or music box including an acoustic display mechanism (100), for a striking timepiece (1000), including a plurality of control-pieces (1) for the same time measurement parameter, staged in parallel planes, and further including melody selection means (3), arranged to be operated by a user or by the timepiece movement, controlling or prohibiting, at a given moment, access of the control-pieces (1) to a common snail (2) corresponding to said time measurement parameter, to allow only one of the control-pieces (1) to operate at least one lever (4) controlling the motion of a hammer to play a melody that is specific thereto or to activate at least one gong that is specific thereto.

27 Claims, 5 Drawing Sheets

MELODY SELECTION MECHANISM FOR A STRIKING TIMEPIECE

This application claims priority from European Patent Application No. 14169217.8 filed on May 21, 2014, the entire disclosure of which is hereby incorporated herein by reference.

FIELD OF THE INVENTION

The invention concerns an acoustic display mechanism for a striking timepiece.

The invention also concerns a timepiece or watch including at least one such acoustic display mechanism.

The invention also concerns a music box including at least one such acoustic display mechanism.

The invention concerns the field of timepieces including an acoustic display, and the related field of music boxes or similar.

BACKGROUND OF THE INVENTION

Striking watches were invented in the past to overcome the absence of night lighting, and to know the time at any moment.

Improvements have made it possible to play melodies, for example by the juxtaposition, in a predetermined order, of sequences controlled by discs or cylinders with holes or pins such as those used in music boxes.

However, striking watches still do not offer all the possibilities provided by watches with a visual display, and in particular a distinction between day/night, morning or afternoon (AM/PM), a distinction between several time zones (GMT), or even the breaking down of time into particular time scales, as desired by the user.

EP Patent Application No 2498145A1 in the name of MONTRES BREGUET SA discloses a striking mechanism with different chimes, with a stage for a repeater unit including a drive plate with a pivoting pipe carrying a click with a beak returned by a spring and movable under the action of a detent ratchet pin cooperating with a strike work control mechanism, this stage including a ratchet which has a pipe and pivots on the pipe to cooperate, on a toothing comprised therein, with the beak of the click, which allows or prohibits rotation of the ratchet, which is integral with a first hour rack cooperating with a first hammer lever. This stage includes, pivoting about the same axis, a second hour rack cooperating with a hammer lever of said striking mechanism.

EP Patent Application No 1770453A1 in the name of CHRISTOPHE CLARET SA discloses a mechanical timepiece including a mechanism for indicating the time of a first and a second time zone, provided with a striking device for producing, as required, a chime corresponding to the time of the first or of the second time zone; this striking device is powered by a single striking barrel controlled by control members intended to release a strike corresponding to the time of the first and of the second time zone.

SUMMARY OF THE INVENTION

The invention proposes to make a timepiece with an acoustic display, particularly a watch, more versatile, by offering the user the possibility of distinguishing between particular circumstances of use according to the melody played and/or the gongs used. These improvements also concern music boxes.

To this end, the invention concerns an acoustic display mechanism for a striking timepiece, characterized in that the mechanism includes a plurality of first control-pieces for a same first time measurement parameter, which are arranged in stages in parallel planes to each other, in that, at a given time, only one of said plurality of said first control-pieces cooperates with a first common snail corresponding to said first time measurement parameter, in that said acoustic display mechanism includes first melody selection means, arranged to be operated by a user or by said timepiece movement, and in that each said first control-piece is controlled, in a plane which is specific thereto, by a first dedicated selector mechanism comprised in said first melody selection means, and controls, via at least one control lifting-piece, the motion of at least one hammer to play a melody that is specific thereto or to actuate at least one gong that is specific thereto.

The invention also concerns a timepiece or watch including at least one such acoustic display mechanism.

The invention also concerns a music box including at least one such acoustic display mechanism.

BRIEF DESCRIPTION OF THE DRAWINGS

Other features and advantages of the invention will appear upon reading the following detailed description, with reference to the annexed drawings, in which:

FIG. 5C corresponds to a different rhythm.

DETAILED DESCRIPTION OF PREFERRED EMBODIMENTS

Figure 1:
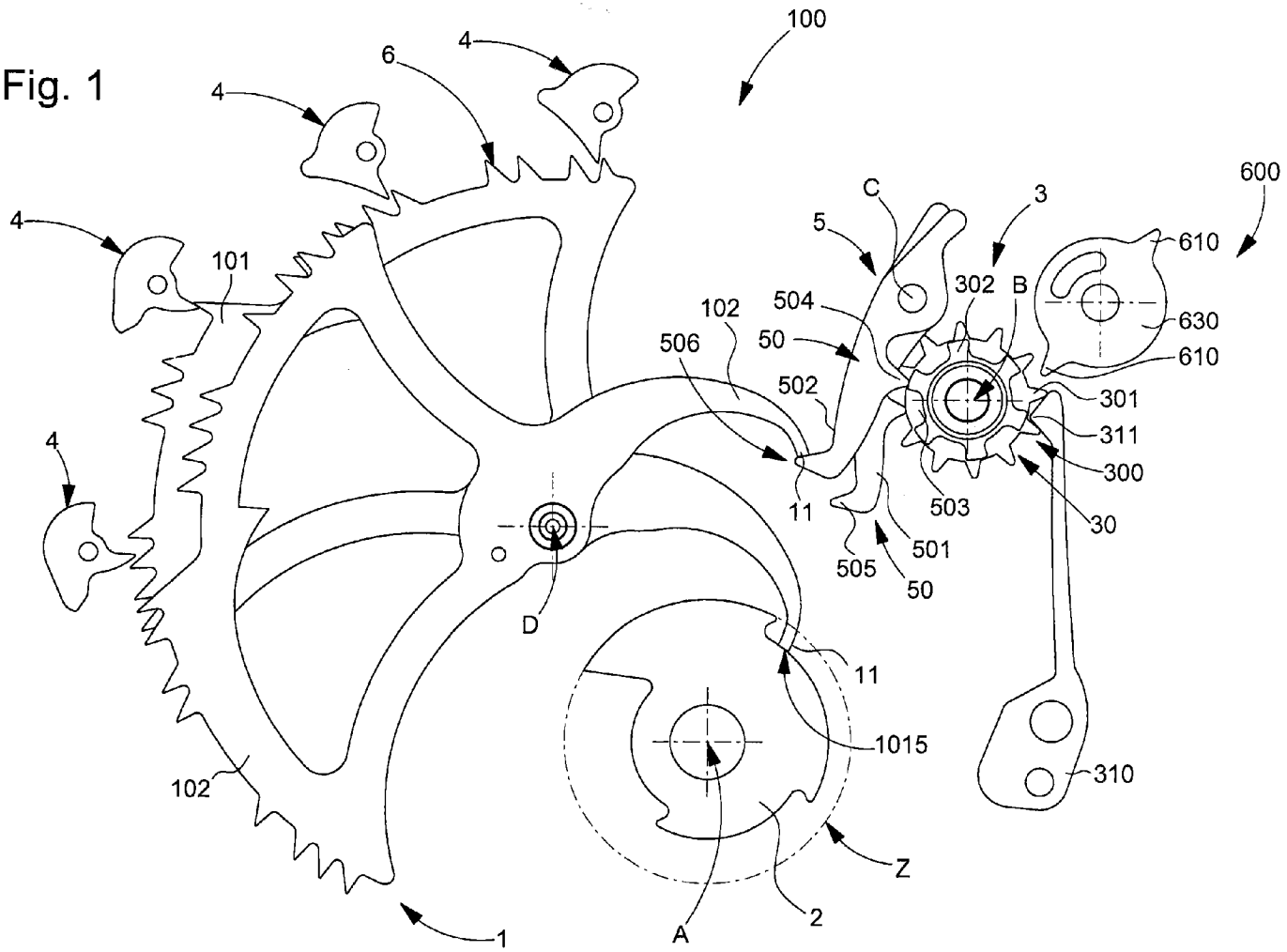
FIG. 1 shows a schematic, plan view of one part of a striking mechanism, wherein one wheel of a watch movement controls a selection means including coaxial star-wheels and controlling the pivoting of levers acting on quarter-pieces in order, at a given moment, to allow only one of these quarter-pieces access to a quarter snail to gather information to perform a strike, this mechanism including several hammer control levers (not shown), each able to cooperate with one or more of these quarter-pieces.

The invention concerns an acoustic display mechanism 100 for a striking timepiece 1000, of the grand strike or small strike or minute repeater or alarm type, or the music box type or similar. The invention is explained here for a timepiece;

those skilled in the art will know how to apply the teachings to a music box or to any other similar mechanism.

The invention proposes to enable the user to select a melody, or a gong, to perform a particular chime, and also to enable a similar selection to be made directly by the movement of timepiece 1000. For example, in this embodiment of the invention, the movement may operate a first chime melody for the hours before noon (AM) and another chime melody for the hours after noon (PM), or differentiate chimes on two consecutive days, or start to play a first chime for a first time zone before starting another chime for a second time zone. The applications are unlimited, and such an acoustic display with particular combinations of chimes and/or gongs may be more meaningful for the user than visual displays that are sometimes difficult to read on astronomical or time zone or similar watches.

According to the invention, this mechanism 100 includes a plurality of first control-pieces 1 for the same first time measurement parameter.

Preferably, these first control-pieces 1 are arranged in stages in parallel planes to each other.

These first control-pieces 1 are also arranged to cooperate with a common reference, notably a first common snail 2 corresponding to this first time measurement parameter. At a given moment, only one of these first control-pieces 1 cooperates with the first common snail 2 to gather information to perform the appropriate strike.

This acoustic display mechanism 100 also includes first melody selection means 3, arranged to be operated by a user or by the movement of timepiece 1000. Each first control-piece 1 comprised therein is controlled, in a plane specific thereto, by a dedicated first selector mechanism 30 comprised in said first melody selection means 3.

Each first control-piece 1 controls, via at least one control lever 4, the motion of at least one hammer to play a melody specific thereto or to actuate at least one gong specific thereto.

FIG. 1 illustrates an example embodiment with an acoustic display mechanism 100 which differentiates between the morning and afternoon chimes (AM/PM), by controlling the actuation, depending on the case, with reference to the time of day transmitted by the timepiece movement to melody selection means 3, of a first quarter-piece 101 for playing a first melody for the morning chimes, or of a second quarter-piece 102 for playing a second melody for the afternoon chimes. These quarter-pieces 101 and 102, visible in FIGS. 5A and 5B, form the control-pieces 1 of mechanism 100.

Preferably, acoustic display mechanism 100 includes several control levers 4, each arranged to control the pivoting of such a hammer, each such control lever 4 is arranged to pivot under the impulse of only one of several such first control-pieces 1 at a time, located in different planes. FIG. 1 thus shows quarter-piece 101 in cooperation with the four peripheral levers 4; the hammers and gongs are not shown to avoid overloading the Figures.

Each such first selector mechanism 30 includes a first uncoupling means 5, on each stage of each first control-piece 1 and is arranged to allow, at a given moment:

only one first control-piece 1, gathering information on the current time on the first common snail 2 of axis A and delimiting an envelope volume Z, to approach a coupled position, and at the same given moment, to uncouple all the other first control-pieces 1 so that they remain outside the progressive pivoting field Z of the first common snail 2 to prevent access thereof to first common snail 2.

In an advantageous and simple embodiment, this first uncoupling means 5 includes, at each such stage, at least one uncoupling lever 50, which is arranged, according to its angular position, to allow or prevent access of the first control-piece 1 specific to the stage concerned, to first common snail 2.

In the example of FIG. 1, a first lever 501, at a lower level, is thus arranged, according to its position, to allow or prevent access of first quarter-piece 101 to snail 2; in a parallel and higher plane, a second lever 502 at a higher level, is arranged, according to its position, to allow or prevent access of second quarter-piece 102 to snail 2. In this Figure, a second selector mechanism 302 made in the form of a star or similar, pushes back a lug 504 of second lever 502, which is thus oriented so that the end 506 thereof blocks feeler spindle 11 of second quarter-piece 102 to prevent any motion thereof, and consequently, access to common snail 2. Conversely, a first selector mechanism star 301 allows the descent, towards axis B, of lug 503 of first lever 501 which is thus eclipsed, the end 505 thereof does not then oppose the passage of feeler spindle 11 of first quarter-piece 101, which is shown with its feeler spindle 11 supported on snail 2 in an information gathering position, and consequently allowing a first melody to be played.

Figure 5A:
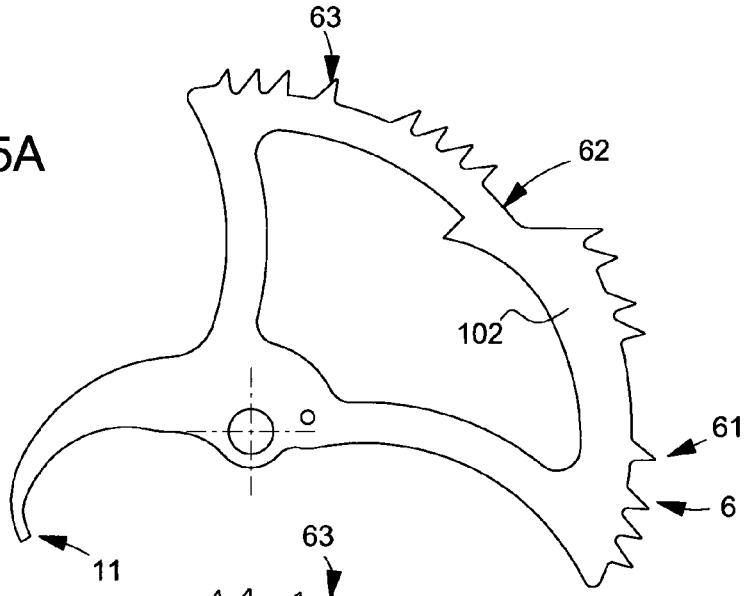
FIGS. 5A, 5B, 5C each show a different control-piece, those of FIGS. 5A and 5B correspond to the diagram of FIG. 1.
Figure 5B:
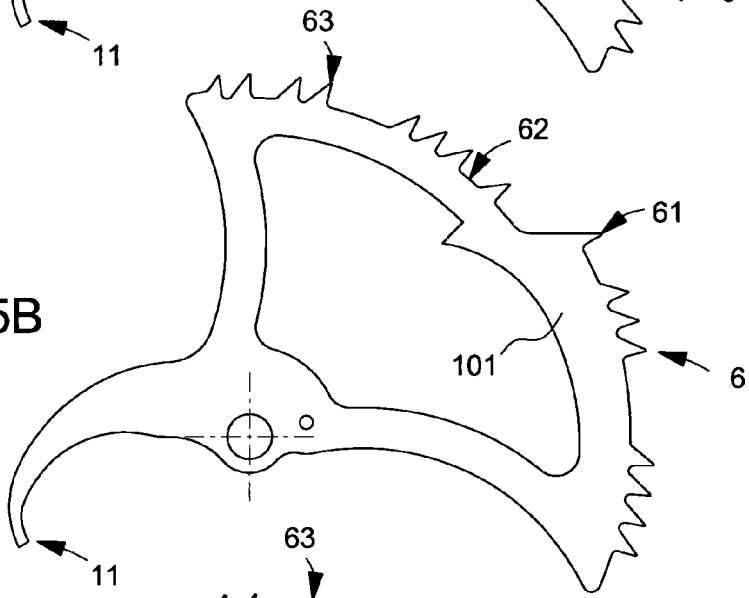
Figure 5C:
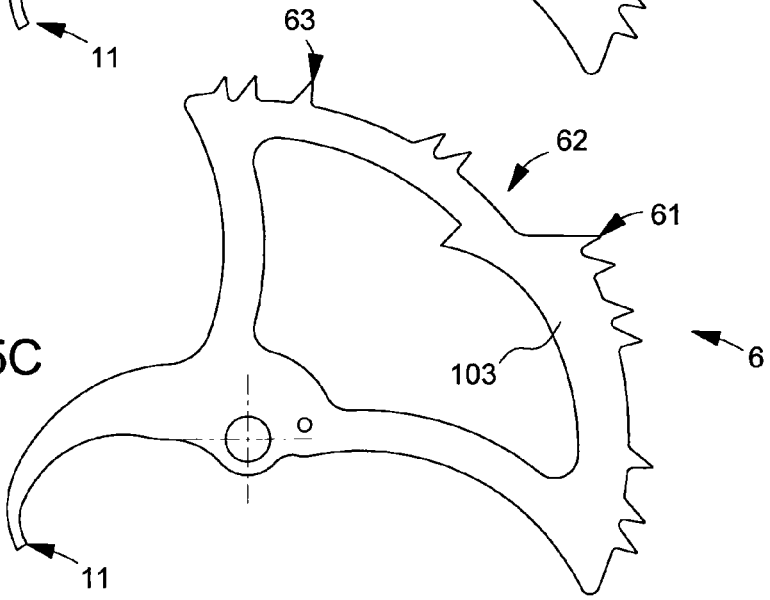

First control-pieces 1 each have a particular toothing profile 6 to activate the execution of a particular melody, as seen in FIG. 1 and in FIGS. 5A, 5B, 5C, with teeth 61 and 63; spaces 62 and the distance between the teeth define the rhythmic sequence.

At least two of these first control-pieces 1 have a different toothing profile to differentiate the chimes.

Figure 3:
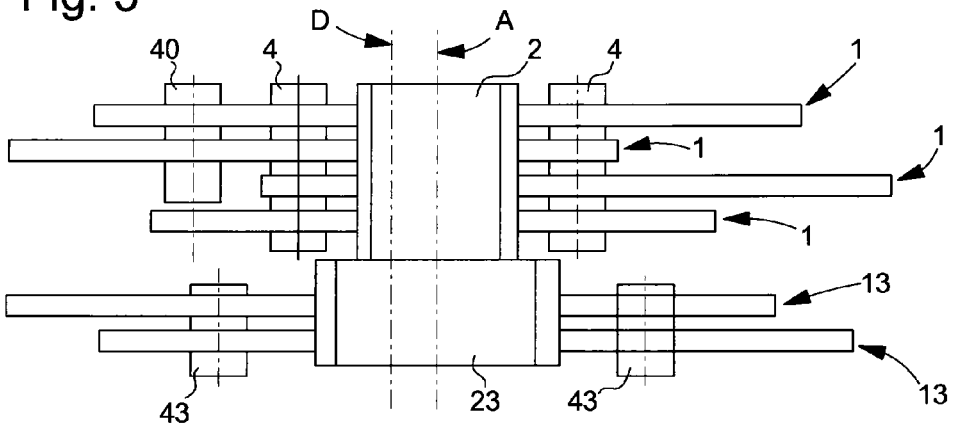
FIG. 3 shows a schematic, partial, side view of two snails corresponding to different time measurement parameters, shown as coaxial here, the upper snail cooperating with four control-pieces arranged to each cooperate with two or three control levers, and the lower snail cooperating with two control-pieces each arranged to cooperate with two other levers, distinct from the preceding ones.

In a variant, only some of the first control-pieces cooperate with a given control lever 4; in the example of FIG. 3, control lever 40 is only accessible to the three first upper control-pieces 1.

Figure 1A:
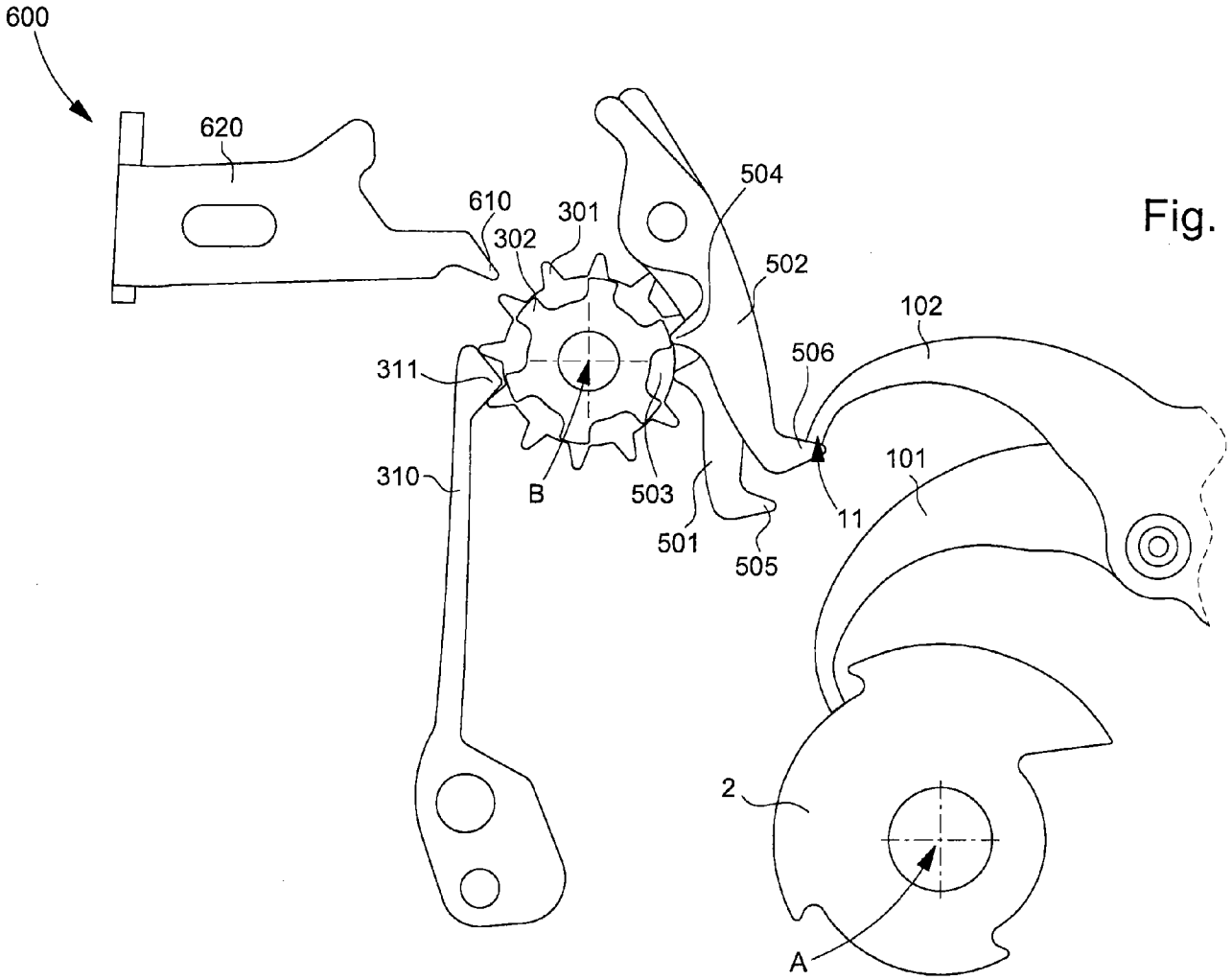
FIG. 1A is a detail of a variant wherein a control means operable by the user actuates a push-piece to control the same selection means including said star-wheels.

In a non-limiting manner, in a particular embodiment illustrated by the Figures, all of the first selector mechanisms 30 comprised in the first melody selection means 3 are coaxial. This is the case of the first selector mechanism 301 and of the second selector mechanism 302 of FIG. 1, about their common axis B. These selectors, which are stars here, are held by the end 311 of a jumper 310. Rotation of the selectors is triggered in this example by a finger 610 of a control means including a wheel 630. This wheel 630 may, depending on the case, be controlled by the timepiece movement, or by action of the user (by analogy with a minute repeater control) or by action of a sensor reacting to a change in a physical parameter in the environment of the timepiece. FIG. 1A is a variant wherein a control means operable by the user, here formed in a non-limiting manner by a control pull-piece 620, activates a push-button with a finger 610 for controlling the same selection means including these stars.

In the non-limiting application illustrated by FIG. 1, the first control-pieces 1 are first quarter-pieces, and first snail 2 is a first quarter snail.

In a variant that is not illustrated, the first control-pieces 1 are first hour-pieces, and first snail 2 is a first hour snail.

In a non-illustrated variant, the first control-pieces 1 are first minute-pieces, and first snail 2 is then a first minute snail.

Figure 2:
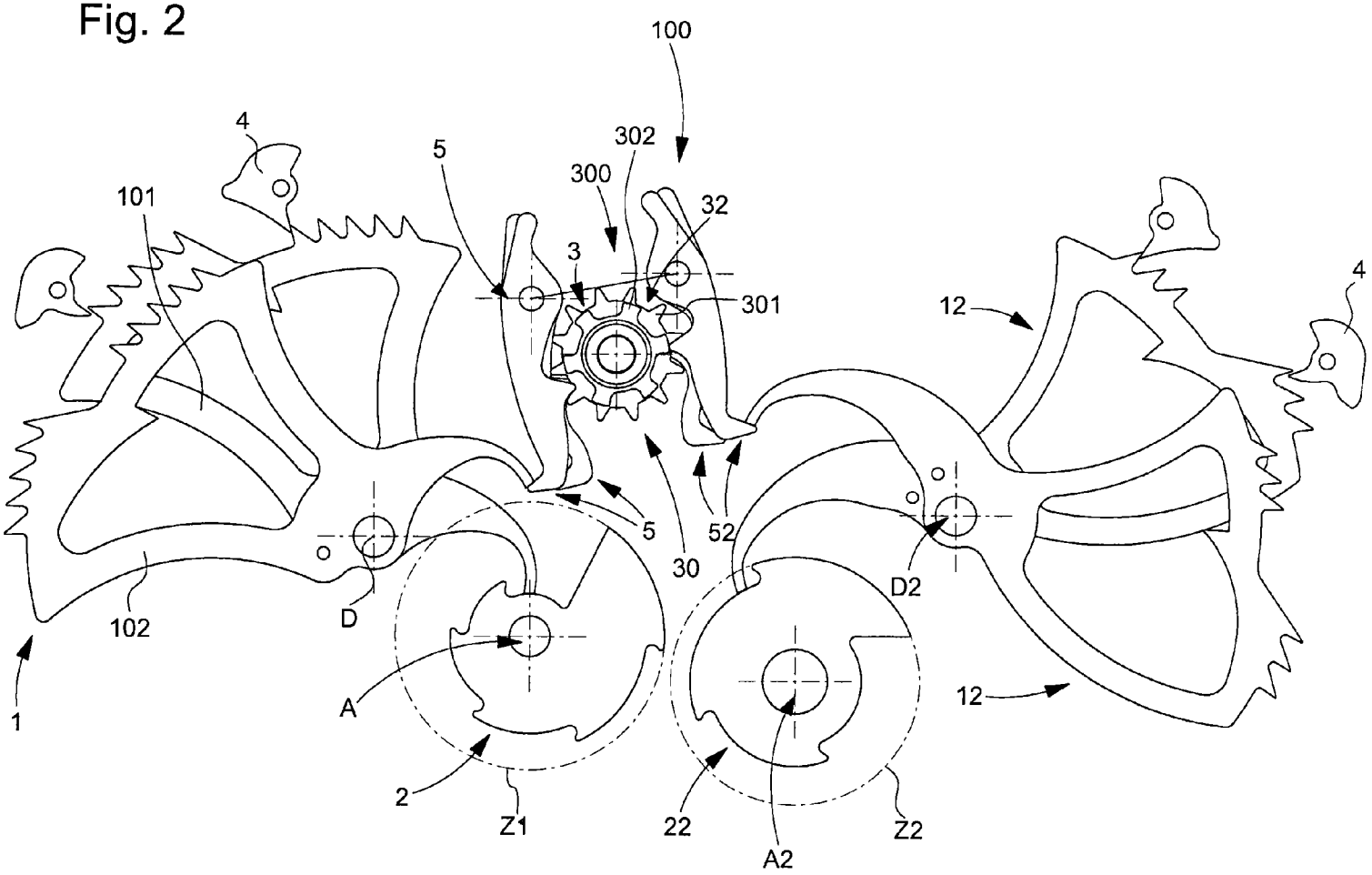
FIG. 2 shows, in a similar manner to FIG. 1, a mechanism including several snails each corresponding to a specific time measurement parameter, each of these snails cooperating with a specific set of hammer lever control-pieces.

In a particular embodiment shown in FIG. 2, melody selection means also control access to a second common snail 22. This second common snail 22 corresponds to a second time measurement parameter and cooperates with a plurality of second control-pieces 12 for the same second time measurement parameter. At a given moment, only one of these second control-pieces 12 cooperates with the second common snail 22 to gather for information to perform the appropriate strike.

These second control-pieces 12 are preferably also arranged in stages in parallel planes to each other.

Acoustic display mechanism 100 thus includes melody selection means, which may be the same first dedicated melody selection means 3 as shown in FIG. 2, or second dedicated melody selection means 32. In the particular case of second dedicated melody selection means 32, each second control-piece 12 is controlled, in a plane specific thereto, by a dedicated selector mechanism comprised in second melody selection means 32 and controls, via at least one control lever 4, the motion of at least one hammer to play a melody specific thereto or to actuate at least one gong which is specific thereto. In a similar manner to that described above, mechanism 100 includes at least a second uncoupling means 52 on each stage of second control-piece 12 and is arranged to allow, at a given moment, one second control-piece 12, gathering information on the current time on second common snail 22, to approach the coupled position, and at the same given moment, to uncouple all of the other second control-pieces 12 so that they remain outside the progressive pivoting field Z2 of second common snail 22 to prevent access thereof to second common snail 22.

In a particular embodiment, first common snail 2 and second common snail 22 are coaxial.

In a particular embodiment, first melody selection means 3 and second melody selection means 32 are coaxial.

In a particular embodiment, all of the second dedicated selector mechanisms comprised in second melody selection means 32 are coaxial.

In a particular embodiment, as seen in FIG. 3, acoustic display mechanism 100 also includes, coaxial to first common snail 2 and in the extension thereof, at least a third common snail 23.

This third common snail corresponds to a third time measurement parameter, and also corresponds to a third domain including a third number of third stages all relating to this third parameter.

FIG. 3 thus illustrates two snails 2 and 23 corresponding to different time measurement parameters, mounted coaxially here, upper snail 2 cooperating with four control-pieces 1 each arranged to cooperate with two or three control levers 4 or 40, and lower snail 23 cooperating with two control-pieces 13 each arranged to cooperate with two other levers 43 distinct from the preceding ones.

The upper portion of FIG. 13 illustrates, in cross-section, a stack of four superposed first control-pieces 1, all arranged to cooperate with the same snail 2 but only one at a time, and all arranged to cooperate with levers 4 but also only one at a time.

In this third domain there is a plurality of staged third control-pieces 13 for the same third time measurement parameter. These third control-pieces 13 are arranged to cooperate with the third common snail 23. Acoustic display mechanism 100 includes third melody selection means. Each such third control-piece 13 is controlled, in a plane specific thereto, by a third dedicated selector mechanism comprised in the third melody selection means, and controls, via at least one lever 4, the motion of at least one hammer to play a melody specific thereto or to actuate at least one gong which is specific thereto.

FIG. 3 shows a variant where two third lower control-pieces 13 cooperate with lower levers 4, which are distinct from upper levers 4 which cooperate with the four upper first control-pieces 1.

In a similar manner to the preceding mechanisms, each such third selector mechanism preferably includes at least a third uncoupling means on each stage of third control-piece 13 and is arranged to allow, at a given moment, only one such third control-piece 13, gathering current time information on third common snail 23, to approach the coupled position, and at the same given moment, to uncouple all the other such third control-pieces 13 so that them remain outside the progressive pivoting field of third common snail 23 to prevent access thereof to third common snail 23.

In a particular embodiment, all of the third selector mechanisms comprised in the third melody selection means are coaxial.

In a particular embodiment, a single control means 600 controls the pivoting, on the one hand, of first melody selection means 3, and on the other hand, of second melody selection means 32 and/or of the third melody selection means when acoustic display mechanism 100 include such means.

Figure 4:
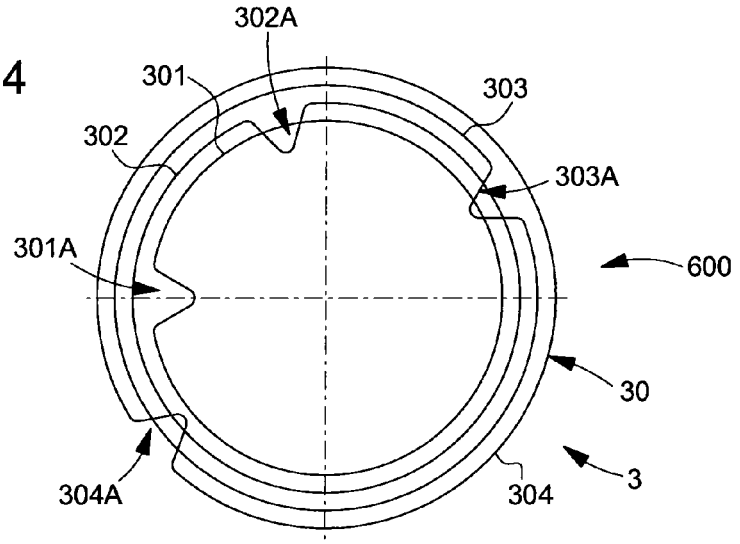
FIG. 4 shows a schematic, plan view of an example of a selection means for the control of four control-piece locking pieces, in the form of four superposed cams each including a notch for cooperation with a lug of a locking lever.

FIG. 4 illustrates an example with a single control means 600 which includes a selection means 3 for the control of four control-piece locking levers, wherein selector mechanism 30 includes four superposed cams 301, 302, 303, 304 each including a notch 301A, 302A, 303A, 304A for cooperation with a lug of a locking lever.

In a particular embodiment, this single control means 600 is a stepped cam.

In a particular embodiment, this single control means 600 is a column-wheel.

In a particular embodiment, acoustic display mechanism 100 includes melody selection means for the simultaneous control of several control-pieces of different types, corresponding to reading on the snails which correspond to time measurement parameters that are different.

The invention also concerns a timepiece 1000 particularly a watch, including at least one such acoustic display mechanism 100. This timepiece 1000 includes, in a conventional manner, a timepiece movement.

In a particular variant, this movement is arranged to operate at least the first melody selection means 3.

In another variant, the movement is arranged to operate a plurality of melody selection means, or all the melody selection means according to the invention, comprised in acoustic display mechanism 100.

In another variant, timepiece 1000 includes control means accessible to the user and arranged to select and operate at least the first melody selection means 3.

In another variant, the control means accessible to the user are arranged to select and operate a plurality of melody selection means, or all of the melody selection means according to the invention comprised in acoustic display mechanism 100.

In another variant, timepiece 1000 includes both, on the one hand a movement thus arranged to operate at least one melody selection means, and on the other hand, control means accessible to the user for operating at least one melody selection means.

The invention also concerns a music box including at least one such acoustic display mechanism 100.

Figure 6:
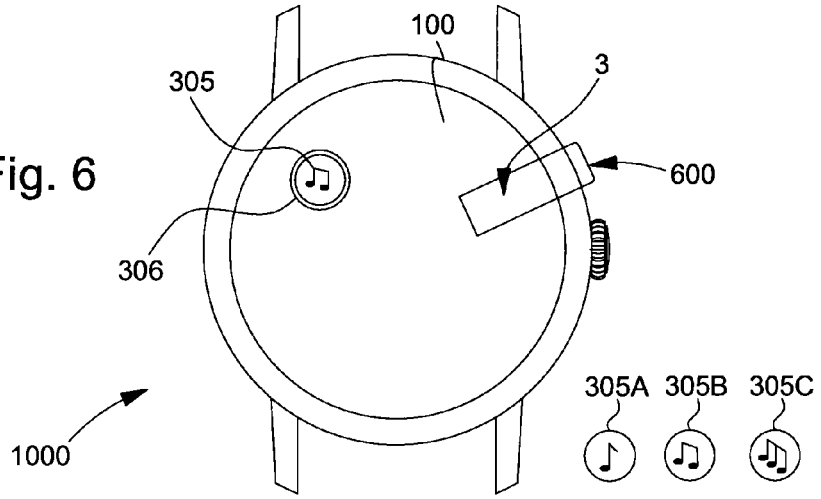
FIG. 6 shows a striking watch, including control means actuating a melody selection means, an aperture reveals a mark identifying the selected melody.

FIG. 6 shows such a striking watch 1000, including control means 600 actuating a melody selection means 3, an aperture 306 reveals a mark 305A, 305B, 305C identifying the selected melody. This mark may appear on a cam section of a selector of the type shown in FIG. 4, or other. When mechanism 100 implements a selection other than that of a particular strike, for example selection of a gong, the same type of display can be used. Naturally, the same type of display can be used when the selection of a melody or gong or time measurement parameter or other selection is accomplished by a command from the movement of watch 1000.

In short, the essential principle of the invention is the placing in parallel of several control-pieces of identical nature, and the selection of one control-piece to produce a particular display sound.

As described in the above example, the invention permits the selection of a melody, but also simply selection of a gong.

The implementation of staged levers that do not interfere with a control-piece on a determined stage, permits particular variations as regards the acoustic displays achieved.

The selection of time parameters, by the selection of the appropriate snail, is also innovative. The selection means thus make it possible to choose, for example, between a conventional display: hour/quarter/minute, and specific displays: hour/10 minutes/minute, by gathering information on 10 minute snails for example.

The advantage of the invention is that it makes it easily possible to combine such variants in complex architectures, for example by combining the embodiments of FIGS. 2 and 3, or similar.

The mechanisms obtained are compact.

The invention also lends itself to the modification of existing acoustic display mechanisms.

What is claimed is:

1. An acoustic display mechanism for a striking timepiece, wherein the mechanism includes a plurality of first control-pieces for a same first time measurement parameter, which are arranged in stages in parallel planes to each other, wherein, at a given moment, only one of said plurality of said first control-pieces cooperates with a first common snail corresponding to said first time measurement parameter, wherein said acoustic display mechanism includes first melody selection means arranged to be operated by a user or by the movement of said timepiece, and wherein each said first control-piece is controlled, in a plane specific thereto, by a first dedicated selector mechanism comprised in said first melody selection means, and controls, via at least one control lever, the motion of at least one hammer to play a melody specific thereto or to actuate at least one gong which is specific thereto.

2. The acoustic display mechanism according to claim 1, wherein the mechanism includes several said control levers, each arranged to control the pivoting of one said hammer, and wherein each said control lever is arranged to pivot under the impulse of only one of said several first control-pieces at a time located in different planes.

3. The acoustic display mechanism according to claim 2, wherein each said first selector mechanism includes at least a first uncoupling means on each said first control-piece stage and is arranged to allow, at a given moment, only one said first control-piece, gathering information on the current time on said first common snail, to approach the coupled position, and at the same given moment, to uncouple all of the other first control-pieces so that said control-pieces remain outside the progressive pivoting field of said first common snail to prevent access thereof to said first common snail.

4. The acoustic display mechanism according to claim 3, wherein said first uncoupling means includes, on each said stage, at least one uncoupling lever arranged, according to the angular position thereof, to allow or prevent the access of said first control-piece of said stage to said first common snail.

5. The acoustic display mechanism according to claim 1, wherein said first control-pieces each have a particular toothing profile to activate the execution of a particular melody.

6. The acoustic display mechanism according to claim 5, wherein at least two of said first control-pieces have a different toothing profile.

7. The acoustic display mechanism according to claim 1, wherein all of said first selector mechanisms comprised in said first melody selection means are coaxial.

8. The acoustic display mechanism according to claim 1, wherein said first control-pieces are first quarter-pieces, and wherein said first snail is a first quarter-snail.

9. The acoustic display mechanism according to claim 1, wherein said first control-pieces are first hour-pieces, and wherein said first snail is a first hour snail.

10. The acoustic display mechanism according to claim 1, wherein said first control-pieces are first minute-pieces, and wherein said first snail is a first minute-snail.

11. The acoustic display mechanism according to claim 1, wherein said first melody selection means also control access to a second common snail, corresponding to a second time measurement parameter, and said second common snail cooperates, at a given moment, with only one of a plurality of second control-pieces, which are arranged in stages in parallel planes to each other, wherein said acoustic display mechanism includes second melody selection means, and wherein each second control-piece is controlled, in a plane specific thereto, by a second dedicated selector mechanism comprised in said second melody selection means and controls, via at least one lever, the motion of at least one hammer to play a melody that is specific thereto or to activate at least one hammer that is specific thereto.

12. The acoustic display mechanism according to claim 11, wherein each said second dedicated selector mechanism includes at least a second uncoupling means on each said second control-piece stage and is arranged to allow, at a given moment, only one said second control-piece, gathering information on the current time on said second common snail, to approach the coupled position, and at the same given moment, to uncouple all of said other second control-pieces so that said control-pieces remain outside the progressive pivoting field of said second common snail to prevent access thereof to said second common snail.

13. The acoustic display mechanism according to claim 11, wherein said first common snail and said second common snail are coaxial.

14. The acoustic display mechanism according to claim 11, wherein all of said second selector mechanisms comprised in said second melody selection means are coaxial.

15. The acoustic display mechanism according to claim 11, wherein a single control means controls the pivoting, on the one hand, of said first melody selection means, and on the other hand, of said second melody selection means and/or third melody selection means when said acoustic display mechanism includes the same.

16. The acoustic display mechanism according to claim 15, wherein said single control means is a stepped cam.

17. The acoustic display mechanism according to claim 15, wherein said single control means is a column-wheel.

18. The acoustic display mechanism according to claim 1, wherein acoustic display mechanism also includes, coaxial to said first common snail and in the extension thereof, at least a third common snail which corresponds to a third time measurement parameter and which corresponds to a third domain including a third number of third stages all relating to said third parameter, and wherein in said third domain there is a plurality of staged third control-pieces for the same said third time measurement parameter, and wherein said third control-pieces are arranged to cooperate with said third common snail, and wherein said acoustic display mechanism includes third melody selection means, and wherein each said third control-piece is controlled, in a plane that is specific thereto, by a third dedicated selector mechanism comprised in said third melody selection means, and controls, via at least one lever, the motion of at least one hammer to play a melody that is specific thereto or to activate at least one gong that is specific thereto.

19. The acoustic display mechanism according to claim 18, wherein each said third dedicated selector mechanism includes at least a third uncoupling means on each said third control-piece stage and is arranged to allow, at a given moment, only one said third control-piece, gathering information on the current time on said third common snail, to approach the coupled position, and at the same given moment, to uncouple all of said other third control-pieces so that said control-pieces remain outside the progressive pivoting field Z of said third common snail to prevent access thereof to said third common snail.

20. The acoustic display mechanism according to claim 18, wherein all of said third dedicated selector mechanisms comprised in said third melody selection means are coaxial.

21. The acoustic display mechanism according to claim 18, wherein a single control means controls the pivoting, on the one hand, of said first melody selection means, and on the other hand, of said second melody selection means and/or third melody selection means when said acoustic display mechanism includes the same.

22. The acoustic display mechanism according to claim 1, wherein the mechanism includes melody selection means for the simultaneous control of several control-pieces of different types corresponding to reading on snails that correspond to different time measurement parameters.

23. A timepiece or watch including at least one acoustic display mechanism according to claim 1.

24. The timepiece according to claim 23, wherein the timepiece includes a movement which operates said first melody selection means.

25. The timepiece according to claim 24, wherein said movement is arranged to operate a plurality of melody selection means.

26. The timepiece according to claim 24, wherein said timepiece includes both, on the one hand, a movement arranged to operate at least one melody selection means, and on the other hand, control means accessible to the user for operating at least one melody selection means.

27. A music box including at least one acoustic display mechanism according to claim 1.

* * * * *